US011957213B2

(12) United States Patent
Fromholtz et al.

(10) Patent No.: US 11,957,213 B2
(45) Date of Patent: Apr. 16, 2024

(54) FLEXIBLE ARCH SUPPORT FOR FOOTWEAR

(71) Applicant: Scholl's Wellness Company LLC, Parsippany, NJ (US)

(72) Inventors: Alexander Fromholtz, Madison, NJ (US); Daniel L. Miranda, Basking Ridge, NJ (US); Harold A. Howlett, Parsippany, NJ (US)

(73) Assignee: Scholl's Wellness Company LLC, Parsippany, NJ (US)

( * ) Notice: Subject to any disclaimer, the term of this patent is extended or adjusted under 35 U.S.C. 154(b) by 0 days.

(21) Appl. No.: 16/870,720

(22) Filed: May 8, 2020

(65) Prior Publication Data

US 2020/0352276 A1 Nov. 12, 2020

Related U.S. Application Data

(60) Provisional application No. 62/845,102, filed on May 8, 2019.

(51) Int. Cl.
*A43B 7/14* (2022.01)
*A43B 17/18* (2006.01)

(52) U.S. Cl.
CPC ..... *A43B 7/1495* (2013.01); *A43B 17/18* (2013.01)

(58) Field of Classification Search
CPC ..... A43B 7/142; A43B 7/1445; A43B 7/1495; A43B 13/183
See application file for complete search history.

(56) References Cited

U.S. PATENT DOCUMENTS 717,523 A * 1/1903 Arrowsmith ..... A43B 7/142 36/166
815,897 A * 3/1906 Arrowsmith ..... A43B 7/142 36/173
899,367 A * 9/1908 Winchell ..... A43B 7/1465 36/156
2,063,625 A * 12/1936 Joseph ..... A43B 7/22 36/181
2,129,424 A * 9/1938 Jay ..... A43B 7/142 36/76 R
2,779,110 A * 1/1957 Howell ..... A43B 7/1465 36/156

(Continued)

FOREIGN PATENT DOCUMENTS

DE 102015109369 A1 * 12/2016 ..... A43B 13/183
WO WO-0074515 A1 * 12/2000 ..... A43B 21/26

(Continued)

OTHER PUBLICATIONS

International Search Report for PCT/US2020/032224, dated Jul. 15, 2020, 2 pages.

(Continued)

*Primary Examiner* — Megan E Lynch
(74) *Attorney, Agent, or Firm* — Lowenstein Sandler LLP

(57) ABSTRACT

An insole for insertion into footwear includes a base, and an arch support located on an underside of the base layer, the arch support including a frame forming at least a portion of a perimeter of the arch support, and multiple ribs extend from a first side of the frame to a second side of the frame, wherein a first set of the ribs is raised relative to a second set of the ribs.

18 Claims, 15 Drawing Sheets

(56) References Cited

U.S. PATENT DOCUMENTS 3,999,558 A * 12/1976 Barnwell ..... A43B 7/1415 36/145
4,075,772 A 2/1978 Sicurella
4,441,499 A * 4/1984 Comparetto ..... A43B 7/1415 36/154
4,619,056 A 10/1986 Lin et al.
5,311,680 A * 5/1994 Comparetto ..... A43B 7/14 36/140
5,720,118 A * 2/1998 Mayer ..... A43B 13/38 36/107
5,903,985 A * 5/1999 DeMarchi ..... A43B 7/1465 36/155
6,192,607 B1 * 2/2001 Kolada ..... A43B 7/142 36/145
6,345,455 B1 * 2/2002 Greer, Jr. ..... A61F 5/14 36/145
6,408,543 B1 * 6/2002 Erickson ..... A43B 3/26 36/100
6,732,457 B2 * 5/2004 Gardiner ..... A43B 7/22 36/155
2004/0040183 A1 * 3/2004 Kerrigan ..... A43B 3/0063 36/144
2004/0118017 A1 * 6/2004 Dalton ..... A43B 7/142 36/44
2006/0048412 A1 * 3/2006 Kerrigan ..... A43B 3/0063 36/27
2006/0254087 A1 11/2006 Fechter
2007/0022630 A1 * 2/2007 Lundy, Jr. ..... A43B 3/0057 36/28
2007/0033834 A1 * 2/2007 Cheskin ..... A43B 7/1415 36/44
2007/0266593 A1 * 11/2007 Schindler ..... A43B 1/0009 36/28
2008/0313927 A1 * 12/2008 Conforti ..... A43B 7/142 36/91
2010/0236096 A1 * 9/2010 Pauk ..... A43B 13/183 36/28
2011/0302805 A1 * 12/2011 Vito ..... A43B 7/1465 36/44
2012/0323724 A1 * 12/2012 Luthi ..... A43B 7/142 705/26.5
2013/0133224 A1 * 5/2013 Tsai ..... A43B 7/148 36/43
2013/0199057 A1 * 8/2013 Hurd ..... A43B 13/122 36/88
2015/0027000 A1 * 1/2015 Barnes ..... A43B 13/183 36/87
2015/0143714 A1 * 5/2015 Tzeng ..... A43B 7/142 36/43
2016/0058123 A1 * 3/2016 Peyton ..... A43B 13/183 36/25 R
2017/0027277 A1 * 2/2017 Anthony ..... A43B 17/02
2017/0251750 A1 * 9/2017 Devoe ..... A43B 7/141
2017/0258176 A1 * 9/2017 Waatti ..... A43B 7/149
2018/0055143 A1 3/2018 Baucom et al.
2018/0192739 A1 * 7/2018 Granger ..... A43B 7/1435
2018/0255872 A1 * 9/2018 Manasiya ..... A43B 17/035
2019/0104805 A1 * 4/2019 Del Biondi ..... A43B 13/183
2019/0125032 A1 * 5/2019 Liu ..... A43B 7/1465

FOREIGN PATENT DOCUMENTS

WO 2008045231 A2 4/2008
WO WO-2014184195 A1 * 11/2014 ..... A43B 13/181
WO WO-2019073504 A1 * 4/2019 ..... A43B 13/181

OTHER PUBLICATIONS

European Search Report for European Patent Application No. 20802323.4, dated Dec. 5, 2022, 8 pages.

* cited by examiner

FLEXIBLE ARCH SUPPORT FOR FOOTWEAR

CROSS-REFERENCE TO RELATED APPLICATIONS

The present application claims the benefit of priority to U.S. Provisional Patent Application No. 62/845,102, filed May 8, 2019, the disclosure of which is hereby incorporated by reference herein in its entirety.

FIELD OF THE INVENTION

This invention relates generally to inserts for footwear and, more specifically, to arch support inserts for footwear.

BACKGROUND OF THE INVENTION

Modern footwear is designed to suit a wide variety of applications. Footwear is evaluated based on how the footwear looks (form), accomplishes the intended application (function), and accommodates the wearer's foot (fit). Footwear designers balance these parameters to meet a wearer's expectations. This balance is important to achieve overall comfort while mitigating the occurrence of foot pain and/or the development of foot disorders. For example, a running shoe might be designed to dampen ground impact while providing cushioning during ground contact and returning energy to propel the runner forward. The designer can adjust the aesthetics of the shoe to appeal to the intended wearer while also providing structural elements to meet length, width, and arch type requirements. Therefore, the running shoe can be appealing, function as intended, and properly fit the wearer's foot. Unfortunately, some footwear does not (or cannot) have a proper balance of form, function, and fit. In fact, the intended purpose for some footwear, such as high-fashion footwear, is aesthetic appeal, which results in a large overlap between form and function that can compromise the ability of the footwear to comfortably fit the wearer's foot and help reduce the occurrence of pain and/or disability.

High heeled shoes, for example, have heel-to-toe drops of between two and five inches with a hard backbone to support the shoe structure. This configuration intentionally shifts the wearer's foot into a more rigid arch structure while transferring the loads observed during walking from the heel and mid-foot to the medial forefoot. This manifests as reduced arch flexibility and increased ball of foot pressure that can cause the wearer acute and chronic pain after extended wear. Ballet flat style shoes are another example of high fashion footwear that overlaps form and function while sacrificing fit and comfort. Like high heeled shoes, ballet flats are typically designed to have a snug fit but are also built to be flexible and move with the wearer's foot. This sock-like form and function compromises the shoes ability to provide any arch support or sufficient cushioning. This compromise can manifest as acute and chronic pain after extended wear.

Traditionally, aftermarket insoles and orthotics are designed to extend the function of certain shoes to provide the wearer with a better fit. A design engineer can use a combination of compliant and rigid materials to provide cushioning to the entire foot and support the heel and arch during gait. These components help stabilize foot motion while distributing the load across a larger area of the foot during gait. This can help improve the comfort of the footwear as well as reduce the incidence of acute and chronic foot pain. Unfortunately, high fashion footwear, such as high heels and ballet flats, often does not accommodate many conventional aftermarket insoles and orthotics well. Arch support is especially difficult to implement in these shoe styles because they are rigid or semi-rigid structures that do not have the needed flexibility to match the varied contours of all heights of high heels or flex and move with a ballet flat during walking. As a consequence, arch support is either left out or created using a build-up of compliant material that adds bulk and, in many instances, further reduces the overall fit and comfort of the footwear.

SUMMARY OF THE INVENTION

According to some embodiments, an insole for footwear includes a flexible yet supportive arch support that can be incorporated into the insole for improving the comfort and fit of a broad range of footwear. The flexible arch support includes a plurality of leaf-spring like ribs that are located at different heights. A first set of the ribs is configured to form a base of the arch portion of the insole and a second set of the ribs is raised relative to the first set. Gaps between ribs increase the flexibility of the arch in the direction perpendicular to the longitudinal direction of the ribs so that the arch support can contour more easily to fit and move with different types of footwear. The ribs may extend from a frame that forms the perimeter of the arch support.

According to some embodiments, an insole for insertion into footwear includes a base; and an arch support located on an underside of the base layer, the arch support including a frame forming at least a portion of a perimeter of the arch support, and multiple ribs extend from a first side of the frame to a second side of the frame, wherein a first set of the ribs is raised relative to a second set of the ribs.

In any of these embodiments, the first set of the ribs may contact the underside of the base layer.

In any of these embodiments, at least a portion of an upper side of the second set of the ribs may be lower than at least a portion of the lower side of the first set of ribs.

In any of these embodiments, a lowest portion of at least one rib of the second set of ribs may be located toward a medial side of the insole.

In any of these embodiments, a central longitudinal portion of at least one rib of the second set of ribs may be uniform in height.

In any of these embodiments, the arch support may be formed of a different material than the base.

In any of these embodiments, the arch support may be formed of a stiffer material than the base.

In any of these embodiments, the ribs may be spaced apart.

In any of these embodiments, the frame and the ribs may be formed of the same material.

In any of these embodiments, the ribs may extend from a lateral side to a medial side of the insole.

In any of these embodiments, the base may include a recess and the arch support can be located in the recess.

In any of these embodiments, the frame may be flush with a bottom of the base around a perimeter of the frame.

In any of these embodiments, at least one end of at least one rib of the second set of ribs may curve downward.

In any of these embodiments, when a bottom side of the insole is placed on a planar surface, a bottom surface of at least one rib of the second set of ribs may contact the planar surface.

In any of these embodiments, ribs of the first set of the ribs may alternate with ribs of the second set of the ribs.

In any of these embodiments, at least one rib of the second set of ribs may have a uniform thickness from a first end of the at least one rib of the second set of ribs to a second end of the at least one rib of the second set of ribs.

In any of these embodiments, at least one rib of the first set of ribs may have a uniform thickness from a first end of the at least one rib of the first set of ribs to a second end of the at least one rib of the first set of ribs.

In any of these embodiments, the base may be formed of a foam or a gel.

In any of these embodiments, the insole may include a heel portion.

In any of these embodiments, the insole may include a forefoot portion.

According to some embodiments, an arch support for insertion into footwear includes a frame forming at least a portion of a perimeter of the arch support and multiple ribs extend from a first side of the frame to a second side of the frame, wherein a first set of the ribs is raised relative to a second set of the ribs.

In any of these embodiments, the first set of the ribs may be configured for facing toward an underside of an arch of a wearer.

In any of these embodiments, at least a portion of an upper side of the second set of the ribs may be lower than at least a portion of the lower side of the first set of ribs.

In any of these embodiments, a lowest portion of at least one rib of the second set of ribs may be located toward a medial side of the arch support.

In any of these embodiments, a central longitudinal portion of at least one rib of the second set of ribs may be uniform in height.

In any of these embodiments, the ribs may be spaced apart.

In any of these embodiments, the frame and the ribs may be formed of the same material.

In any of these embodiments, the ribs may extend from a lateral side to a medial side of the arch support.

In any of these embodiments, at least one end of at least one rib of the second set of ribs may curve downward.

In any of these embodiments, when a bottom side of the arch support is placed on a planar surface, a bottom surface of at least one rib of the second set of ribs may contact the planar surface.

In any of these embodiments, ribs of the first set of the ribs may alternate with ribs of the second set of the ribs.

In any of these embodiments, at least one rib of the second set of ribs may have a uniform thickness from a first end of the at least one rib of the second set of ribs to a second end of the at least one rib of the second set of ribs.

In any of these embodiments, at least one rib of the first set of ribs may have a uniform thickness from a first end of the at least one rib of the first set of ribs to a second end of the at least one rib of the first set of ribs.

In any of these embodiments, the arch support may be configured for inclusion in an insole.

In any of these embodiments, at least a portion of the insole may be made from a different material than the arch support.

BRIEF DESCRIPTION OF THE DRAWINGS

The invention will now be described, by way of example only, with reference to the accompanying drawings, in which.

DETAILED DESCRIPTION OF EXEMPLARY EMBODIMENTS

Figure 1A:
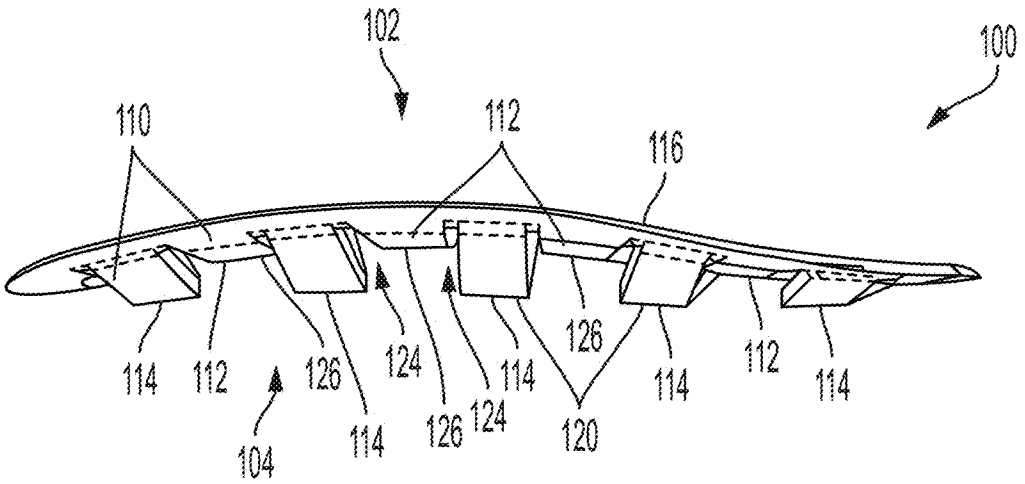
FIGS. 1A-C illustrate side, top, and front views, respectively, of a flexible arch support, according to some embodiments.

Described herein are embodiments of flexible arch supports and insoles having flexible arch supports. According to various embodiments, the flexible arch support is configured with alternating supportive leaf spring ribs separated by gaps in material. The ribs may be braced by an outer support brim or frame. A first set of ribs extends downward forming at least a portion of the bottom of the arch support for contacting a wearer's footwear. A second set of ribs form at least a portion of the plantar surface of the arch support for contacting a wearer's foot or the base of an insole.

The alternating bottom and plantar contact leaf spring ribs are configured to support the arch structure of the foot by functioning as independent leaf springs that provide tailored support to the wearer's arch under different loading conditions. The gaps between the leaf springs ribs are configured to allow the flexible arch support to flex in the direction perpendicular to the orientation of the semi-elliptical leaf springs.

The flexible arch support may be one unitary construction that may be manufactured from any of a wide variety of materials, using, for example, injection molding or 3D printing techniques. The flexible arch support may be tailored for different purposes by modifying one or both of the leaf spring rib geometry and material properties. For example, the semi-elliptical leaf spring height and orientation may be configured to be larger on the medial side or to be more uniform across the medial-lateral direction depending on the desired function, shoe shape, and/or wearer's anatomy. Moreover, the alternating semi-elliptical leaf spring structures may be tailored to provide a range of support by changing the material properties from compliant to stiff and visa-versa.

A conventional arch shell is designed to have a contoured but uniformly rigid shape that acts as a supportive spring under the arch during the stance phase of gait. These conventional arch supports are commonly used to effectively support the arch in a variety of footwear. However, the conventional arch supports are resistant to bending forces and do not provide the needed flexibility to be effectively incorporated into high fashion footwear, such as high heel shoes and ballet flats. Conversely, the flexible arch support described herein, according to various embodiments, is configured to reduce the material stress when subjected to bending loads relative to a conventional arch shell design, allowing for greater displacement or flexion in the direction perpendicular to the leaf spring ribs while still providing support for the arch structure of the foot during gait.

In the following description of the disclosure and embodiments, reference is made to the accompanying drawings in which are shown, by way of illustration, specific embodiments that may be practiced. It is to be understood that other embodiments and examples may be practiced, and changes may be made, without departing from the scope of the disclosure.

In addition, it is also to be understood that the singular forms "a," "an," and "the" used in the following description are intended to include the plural forms as well, unless the context clearly indicates otherwise. It is also to be understood that the term "and/or"," as used herein, refers to and encompasses any and all possible combinations of one or more of the associated listed items. It is further to be understood that the terms "includes, "including," "comprises," and/or "comprising," when used herein, specify the presence of stated features, integers, steps, operations, elements, components, and/or units, but do not preclude the presence or addition of one or more other features, integers, steps, operations, elements, components, units, and/or groups thereof.

As used herein, insole broadly refers to any insert into footwear for supporting the underside of a wearer's foot and includes orthotics, aftermarket inserts, and inserts that are built into footwear by the footwear manufacturer.

Figure 1C:
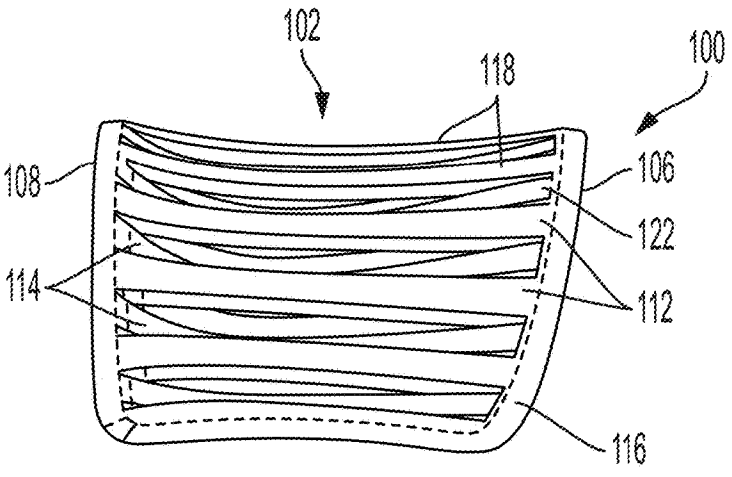
Figure 1B:
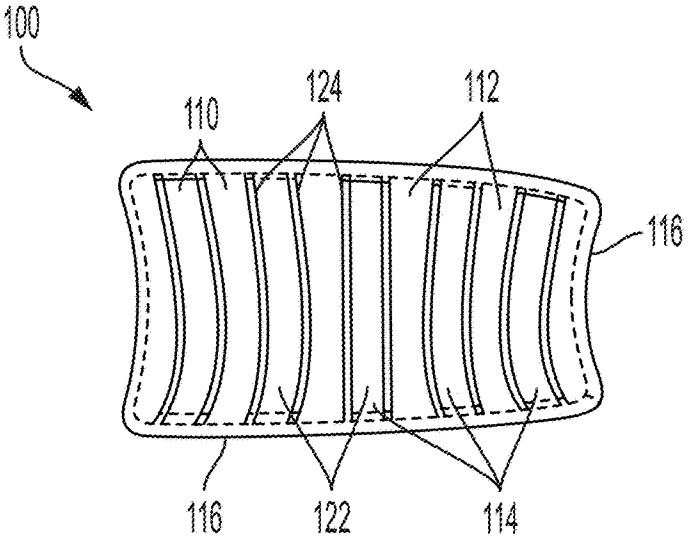

FIGS. 1A-C illustrate medial side, top, and front views, respectively, of a flexible arch support 100 having an array of leaf spring ribs, according to some embodiments. The flexible arch support 100 may be built into an insole or may be used by itself. The flexible arch support 100 includes a plantar side 102 that faces in the direction of a wearer's foot, a bottom side 104 that faces and may contact the plantar side of a wearer's footwear, a medial side 106 that underlies the medial side of a wearer's foot, and a lateral side 108 that underlies the lateral side of a wearer's foot. Ribs 110 extend from the medial side 106 to the lateral side 108 for supporting a wearer's arch while providing flexibility to conform to different footwear. The ribs 110 are spaced apart by gaps 124 so that the ribs 110 form independent leaf springs that provide increasing levels of resistance as they are loaded, providing support to a wearer's arch. The gaps 124 provide flexibility to the arch support 100 in the direction perpendicular to the longitudinal extent of the ribs 110, so that the arch support 100 may bend more easily than, for example, a monolithic arch shell.

In some embodiments, the flexible arch support 100 is configured for placement directly beneath the arch of a typical wearer's arch. For example, the flexible arch support 100 may be configured to extend longitudinally from at least the talus-navicular joint of a typical target wearer's foot to the medial cuneiform-first metatarsal joint and laterally under at least the medial cuneiform bone to support the arch cavity when the flexible arch support is in use.

In the illustrated embodiment, the ribs 110 are configured into two sets of ribs in which ribs from the first set alternate with ribs from the second set. A first set of ribs 112 extend along the plantar side 102 of the arch support 100. A second set of ribs 114 extend lower than the first set of ribs and collectively form at least a portion of the base side 104 of the arch support 100. A frame 116 forms a perimeter of the arch support 100 and the ends of each rib extend from the frame 116. In the illustrated embodiment, the frame 116 extends fully around the perimeter of the arch support 100, but in other embodiments, the frame may form only a portion of the perimeter of the arch support, such as first and second sides where the ribs 110 end. During use, as the wearer applies pressure to the arch support, the first set of ribs 112 and the second set of ribs 114 move toward each other, acting as opposing leaf springs, providing increased resistance as more pressure is applied.

The frame 116 and the upper surfaces 118 of the first set of ribs 112 may be configured to form a plantar side 102 that contours according to a typical target wearer's foot. For example, with respect to the medial side view of FIG. 1A, the plantar side 102 may curve upward from the front to the middle of the arch support 100 and then curve back downward to the rear of the arch support 100. With respect to the front view of FIG. 1C, at least some of the ribs of the first set of ribs 112 may dip downward in the middle so that the plantar side has a convex shape medially to laterally. The portion of the frame 116 on the medial side 106 and the portions of the ribs 110 extending therefrom may be higher than the portion of the frame 116 on the lateral side 108, thus tracking the arch of a typical wearer's foot.

The second set of ribs 114 may be configured to form a bottom side 104 that contours according to a typical target wearer's footwear. For example, from front to back, the bottom surfaces 120 of the second set of ribs 114 in the illustrated embodiment collectively form a somewhat convex surface for footwear that includes a slight upward curve in the arch area. In other embodiments, the bottom surfaces 120 form a flat surface and may be configured to form any suitable surface shape. Medially to laterally, the second set of ribs 114 may be configured to provide a flat central portion that rises on the medial and lateral sides (see, for example, FIG. 6) or may be configured to provide a lowest point that is off-center, such as to the medial or lateral side (see, for example, FIG. 8).

As stated above, the second set of ribs 114 dip downward relative to the first set of ribs 112. Thus, the upper surfaces 122 of the second set of ribs 114 are below the portion of the plantar side 102 of the arch support 100 formed by the first set of ribs 112. With the arch support 100 placed in an article of footwear (such as by itself or incorporated into an insole), the first set of ribs 112 and at least a portion of the upper surface of the frame 116 receive the initial pressure applied from above (either directly by a user's foot or by a portion of an insole into which the arch support 100 is incorporated, as discussed further below), while the second set of ribs 114 receive the initial pressure from the footwear. As additional pressure is applied to the arch support, such as when a wearer stands on the foot, the two sets of ribs are compressed toward one another.

As illustrated in FIG. 1A-1C, gaps 124 are provided between adjacent ribs. The gaps 124 provide flexibility in the direction perpendicular to the longitudinal direction of the ribs 112. This may enable the arch support 100 to conform to, for example, high heels that have large heel to toe drops and/or to move along with highly flexible footwear, such as ballet flats.

The ribs 110 may be configured in any suitable shape in profile and cross-section. For example, in profile, one or more ribs may form a semi-ellipse, and may have a flat central portion with curved end portions, or may have a maximum dip that is offset from the center. Ribs of the same arch support may have the same shape or may have different shapes. Ribs of the first set of ribs 112 may have a different shape than ribs of the second set of ribs 114. For example, ribs of the first set of ribs may have a flat central section while ribs of the second set of ribs may have a maximum dip toward a medial side of the arch support to provide more support at the highest portion of a wearer's foot.

Ribs may have any suitable cross-sectional shape. For example, in some embodiments, ribs may have a rectangular cross section, with flat upper and lower surfaces and straight sides, while in other embodiments, ribs may have one side that is flat and another side that is curved. Ribs of the first set of ribs 112 may have a different cross-sectional shape than ribs of the second set of ribs 114. For example, ribs of the first set of ribs 112 may have an upper surface 118 that is contoured for a wearer's foot and lower surfaces 126 that are flat while ribs of the second set of ribs 114 may have a contoured bottom surface 120 and a flat upper surface 122.

In the illustrated embodiment, the two sets of ribs alternate such that a rib from the first set of ribs is adjacent to a rib from the second set of ribs. In other embodiments, a different pattern may be used, such as a repeating pattern of two first set ribs followed by one second set rib or a repeating pattern of two first set ribs followed by two second set ribs, or any other suitable pattern. Further, while the ribs 110 in the illustrated embodiment extend side-to-side medially to laterally, ribs according to various other embodiments may extend directly front-to-back or at any angle between directly side-to-side and directly front-to-back.

According to some embodiments, a flexible arch support, such as arch support 100, may be incorporated into an insole, as discussed further below. In other embodiments, the flexible arch support is a standalone insert that may be used by itself to support just the user's arch.

Figure 1D:
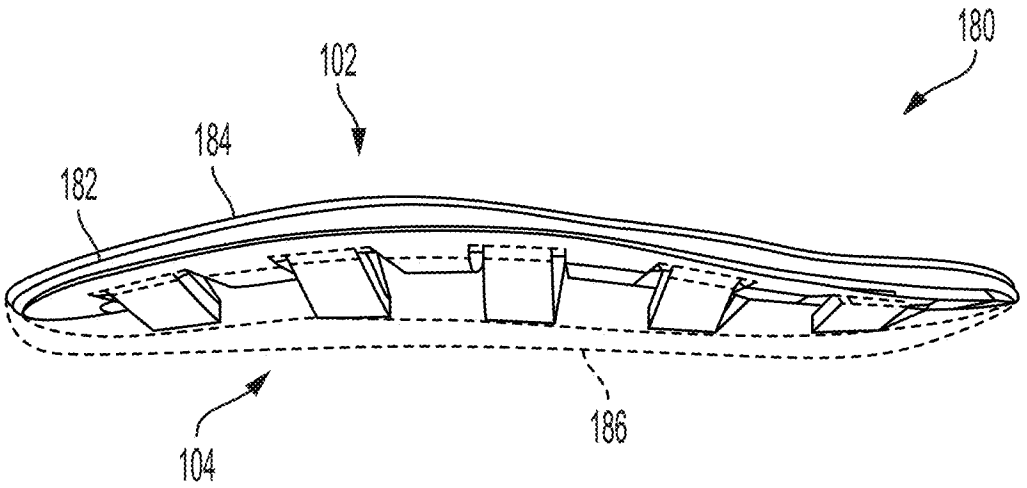
FIG. 1D illustrates a flexible arch support in which a layer of material is provided on the plantar side, according to some embodiments.
Figure 2:
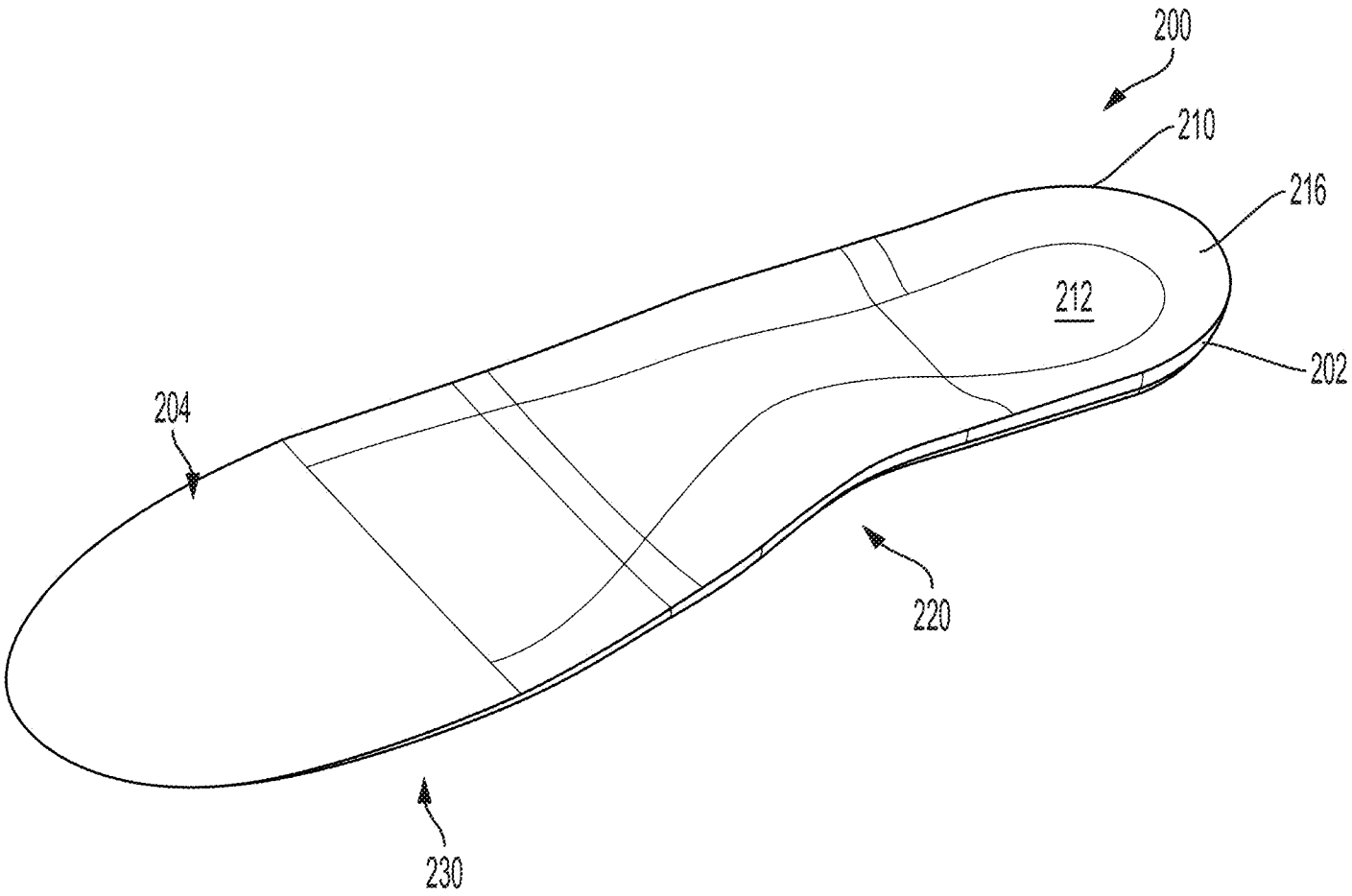
FIG. 2 illustrates a top perspective view of a right foot insole, according to an embodiment.
Figure 3:
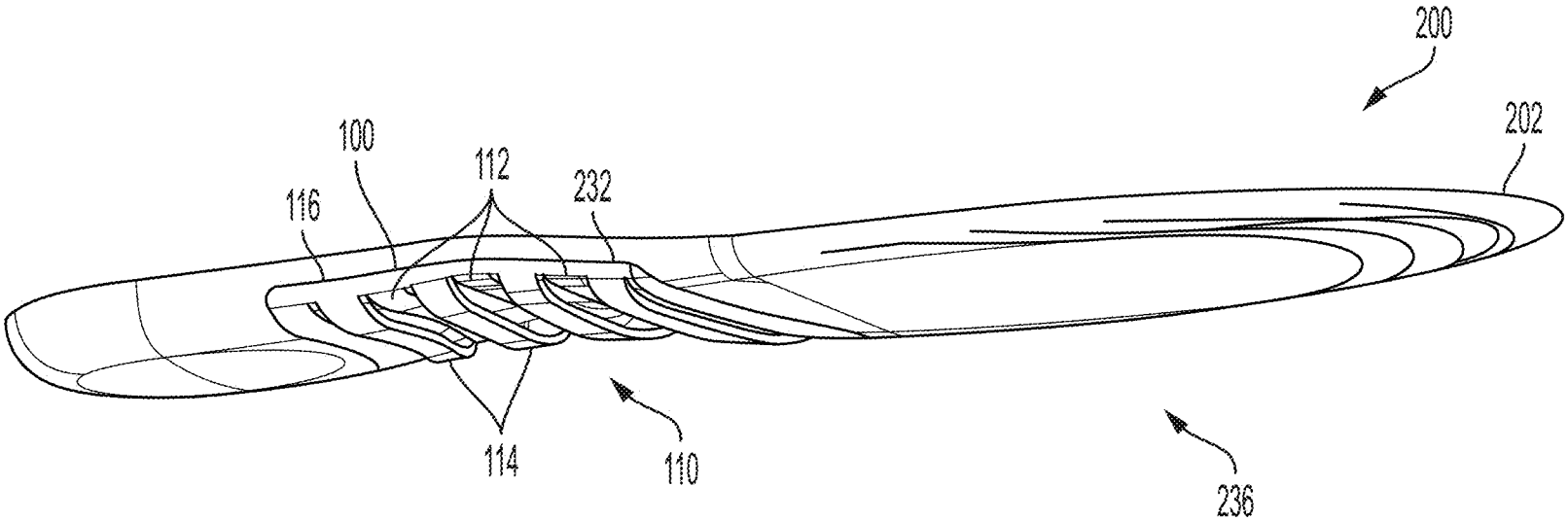
FIG. 3 illustrates a bottom perspective view of an insole, according to some embodiments.

In some embodiments, a standalone flexible arch support may include one or more layers on one or more of the plantar side 102 and the bottom side 104 of the arch support. The additional layer or layers may facilitate use of the arch support as a standalone insert. FIG. 1D illustrates a flexible arch support 180, according to one embodiment, in which a layer 182 of material, such as foam and/or gel, is provided on the plantar side 102. An additional layer 184, such as a fabric layer, may be added to the upper side of the layer 182. The foam, gel, and/or fabric layers may provide additional comfort to the user. In some embodiments, the bottom side 104 may be provided with a fabric layer, foam layer, and/or gel layer. In some embodiments, the entire flexible arch support is encased in one or more layers of material, such as a foam material. For example, in addition to the foam layer 182 on the plantar side 102, the flexible arch support may include a foam layer 186 on the bottom side 104. In some embodiments, the bottom side 104 is textured or provided with a sticky material to prevent the flexible arch support from sliding in a user's footwear, which may be particularly advantageous for embodiments in which the flexible arch support is a standalone insert since there is less surface area for contacting the footwear. The sticky texturing or material may be provided directly on the bottom surfaces of the second set of ribs or on any layer disposed on the bottom side 104 of the flexible arch support.

FIGS. 2-6 illustrate a right-foot insole 200, according to some embodiments, which includes a flexible arch support according to the principles discussed above. Insole 200 is configured to be placed in an article of footwear to provide cushioning and support. Although the figures and following description describe a right-foot insole, it is to be understood that the left-foot insole is generally a mirror image of the right-foot insole and, thus, the features described below pertain to a left-foot insole as well.

Insole 200 includes a heel portion 210, a midfoot portion 220, and a forefoot portion 230. The perimeter of insole 200 is generally shaped to follow the outline of a typical wearer's foot. Moving from back to front along the insole 200, the forefoot portion 230 broadens slightly to a maximum width that is configured to be located generally beneath the broadest portion of a wearer's foot (i.e., beneath the distal heads of the metatarsals). The forefoot portion 230 then narrows into a curved end that may be shaped to follow the general outline of the toes of a typical wearer's foot. Moving rearward from forefoot portion 230, the midfoot portion 220 and heel portion 210 narrow slightly to a curved end configured to follow the outline of a typical wearer's heel.

The forefoot portion 230 may be generally flat. In some embodiments, the forefoot portion 230 has a uniform thickness. In other embodiments, forefoot portion 230 may include a nonuniform thickness with one or more areas of increased thickness that, for example, are located to provide additional support at areas of maximum pressure on a wearer's forefoot. For example, an area of increased thickness may be provided at an area of the forefoot portion 230 located proximal to the wearer's second and third metatarsals, which is typically the location of the greatest pressure in the forefoot during the "toe off" phase of a step.

Forward to rearward, the upper surface of the midfoot portion 220 is contoured to follow the shape of a wearer's arch. This contour can be achieved, at least in part, by the respective configurations of the sets of ribs of the flexible arch support 100. In some embodiments, at least a portion of the contour of the midfoot portion 220 may be achieved by an increase in thickness of a base 202 of the insole that the arch support 100 is received in.

The midfoot portion 220 may be contoured across its width such that one or both of the sides of the midfoot portion 220 extend upwardly. The upward extension of the inside 228 (medial side) of the midfoot portion (the portion that underlies the arch of a wearer's foot) may be configured to follow the contour of the user's arch. The upward extension of the outside 229 (lateral side) of the midfoot portion can provide additional support to the outside of the wearer's foot. The upward extensions of the inside and outside of the midfoot portion 220 may be achieved by increased thickness of the base 202, by contouring of the overall midfoot portion 220, and/or by the configuration of the arch support 100.

The heel portion 210 is generally cup shaped and configured to underlie a typical wearer's heel. The heel portion 210 may include a relatively flat central portion 212 and a sloped side wall 216 that extends around the sides and rear of the flat central portion 212. Generally, when a heel strikes a surface, the fat pad portion of the heel spreads out. A cupped heel portion thereby stabilizes the heel of the wearer and maintains the heel in the heel portion 210, preventing spreading out of the fat pad portion of the heel and also preventing any side-to-side movement of the heel in the heel portion 210. The thickness of the central portion 212 of the heel portion 210 may be uniform. The thickness may be uniform with the thickness of the midfoot portion 220 or may be greater than or less than the thickness of the midfoot portion 220. In some embodiments, the thickness of the heel portion is nonuniform, for example, with a thicker section located centrally in the heel portion such that the area immediately beneath a wearer's heel provides the most cushioning.

The bottom surface of insole 200 (the surface that contacts the footwear into which it is inserted), may or may not include texturing. Texturing may be useful to provide greater grip to the footwear, preventing shifting of the insole 200 within the footwear. Texturing may be provided on any of the forefoot portion 230, the midfoot portion 220, and the heel portion 210. In some embodiments, the forefoot portion 230 includes one or more pattern trim lines for indicating where to trim the insole 200 to fit into smaller size footwear.

The base 202 of the insole 200 may extend the entire length of insole 200. In some embodiments, a cover layer 204 is secured to the upper surface of the base 202 along the entire length of the insole 200 for contacting a user's foot. The cover layer 204 may be secured by any suitable means, such as adhesive, radio frequency welding, etc.

The base 202 may be made from any suitable material including, but not limited to, any flexible material that may cushion and absorb the shock from heel strike on the insole. Suitable shock absorbing materials may include any suitable foam, such as, but not limited to, cross-linked polyethylene, poly(ethylene-vinyl acetate), polyvinyl chloride, synthetic and natural latex rubbers, neoprene, block polymer elastomers of the acrylonitrile-butadiene-styrene or styrene-butadiene-styrene type, thermoplastic elastomers, ethylenepropylene rubbers, silicone elastomers, polystyrene, polyuria, or polyurethane; preferably a flexible polyurethane foam made from a polyol chain and an isocyanate such as a monomeric or prepolymerized diisocyanate based on 4,4'-diphenylmethane diisocyanate (MDI) or toluene diisocyanate (TDI). Such foams may be blown with fluorocarbons, water, methylene chloride or other gas producing agents, as well as by mechanically frothing to prepare the shock absorbing resilient layer. Such foams advantageously may be molded into the desired shape or geometry. The base 202 may be made from block copolymer styrene-ethylene-butylene-styrene (SEBS) or from a combination of SEBS and ethylene-vinyl-acetate (EVA). In some embodiments, the base 202 is formed from 4012-55N and/or 4011-55N SEBS, manufactured by TSRC Corporation of Taiwan. In some embodiments, the base 202 is made from a combination of 4012-55N SEBS, 4011-55N SEBS and EVA. In some embodiments, S19-054 SEBS GEL manufactured by TSRC may be used, 108A/B polyurethane foam manufactured by PVI Chemical Co. of Taiwan may be used, a combination of EVA and 108A/B polyurethane foam may be used, or a combination of any of these materials or any other suitable materials may be used.

Non-foam elastomers such as the class of materials known as viscoelastic polymers, or silicone gels, which show high levels of damping when tested by dynamic mechanical analysis performed in the range of −50 degrees C. to 100 degrees C. may also be advantageously employed. Resilient polyurethane may be prepared from diisocyanate prepolymer, polyol, catalyst and stabilizers that provide a waterblown polyurethane foam of the desired physical attributes. Suitable diisocyanate prepolymer and polyol components include polymeric MDI M-10 (CAS 9016-87-9) and Polymeric MDI MM-103 (CAS 25686-28-6), both available from BASF, Parsippany, N.J. U.S.A.; Pluracol 945 (CAS 9082-00-2) and Pluracol 1003, both available from BASF, Parsippany, N.J. U.S.A.; Multrinol 9200, available from Mobay, Pittsburgh, Pa. U.S.A.; MDI diisocyanate prepolymer XAS 10971.02 and polyol blend XUS 18021.00 available from Dow Chemical Company, Midland, Mich. U.S.A.; and Niax 34-28, available from Union Carbide, Danbury, Conn. U.S.A.

These urethane systems generally contain a surfactant, a blowing agent, and an ultraviolet stabilizer and/or catalyst package. Suitable catalysts include Dabco 33-LV (CAS 280-57-9, 2526-71-8), Dabco X543 (CAS Trade Secret), Dabco T-12 (CAS 77-58-7), and Dabco TAC (CAS 107-21-1) all obtainable from Air Products Inc., Allentown, Pa. U.S.A.; Fomrez UL-38, a stannous octoate, from the Witco Chemical Co., New York, N.Y. U.S.A. or A-1 (CAS 3033-62-3) available from OSI Corp., Norcross, Ga. U.S.A. Suitable stabilizers include Tinuvin 765 (CAS 41556-26-7), Tinuvin 328 (CAS 25973-55-1), Tinuvin 213 (CAS 104810-48-2), Irganox 1010 (CAS 6683-19-8), Irganox 245 (CAS 36443-68-2), all available from the Ciba Geigy Corporation, Greensboro, N.C. U.S.A., or Givsorb UV-1 (CAS 057834-33-0) and Givsorb UV-2 (CAS 065816-20-8) from Givaudan Corporation, Clifton, N.J. U.S.A. Suitable surfactants include DC-5169 (a mixture), DC190 (CAS68037-64-9), DC197 (CAS69430-39-3), DC-5125 (CAS 68037-62-7) all available from Air Products Corp., Allentown Pa. U.S.A. and L-5302 (CAS trade secret) from Union Carbide, Danbury Conn. U.S.A.

Base 202 may be made from a urethane molded material, such as a soft, resilient foam material having Shore Type OO Durometer hardness in the range of 40 to 70, as measured using the test equipment sold for this purpose by Instron Corporation of Canton Mass. U.S.A. Preferably the base layer has a Shore Type OO Durometer hardness in the range of 45 to 55, and more preferably, in the range of 48 to 52. Such materials provide adequate shock absorption for the heel and cushioning for the midfoot and forefoot.

Alternatively, the base 202 may be a laminate construction, that is, a multi-layered composite of any of the above materials. Multi-layered composites are made from one or more of the above materials such as a combination of EVA and polyethylene (two layers), a combination of polyurethane and polyvinyl chloride (two layers), or a combination of ethylene propylene rubber, polyurethane foam, and EVA (3 layers). In some embodiments, the base 202 is made from a layering of EVA and SEBS.

The base 202 may be prepared by conventional methods, such as heat sealing, ultrasonic sealing, radio-frequency sealing, lamination, thermoforming, reaction injection molding, and compression molding, if necessary, followed by secondary die-cutting or in-mold die cuffing. Representative methods are taught, for example, in U.S. Pat. Nos. 3,489,594; 3,530,489; 4,257,176; 4,185,402; 4,586,273, in Handbook of Plastics, Herber R. Simonds and Carleton Ellis, 1943, New York, N.Y.; Reaction Injection Molding Machinery and Processes, F. Melvin Sweeney, 1987, New York, N.Y.; and Flexible Polyurethane Foams, George Woods, 1982, New Jersey; Preferably, the insole is prepared by a foam reaction molding process such as is taught in U.S. Pat. No. 4,694,589. In some embodiments, the base 202 is prepared by a conventional direct injection expanded foam molding process. An example of a conventional direct injection molding machine model is KSC908 LE2A, made by King Steel Machinery Co., LTD. of Taiwan.

The cover layer 204 may be made from any suitable material including, but not limited to, fabrics, leather, leatherboard, expanded vinyl foam, flocked vinyl film, coagulated polyurethane, latex foam on scrim, supported polyurethane foam, laminated polyurethane film or in-mold coatings such as polyurethanes, styrene-butadiene rubber, acrylonitrile-butadiene, acrylonitrile terpolymers and copolymers, vinyls, or other acrylics, as integral top covers. Desirable characteristics of the cover layer 204 include good durability, stability and visual appearance. It is also desirable that the cover layer 204 has good flexibility, as indicated by a low modulus, in order to be easily moldable. The bonding surface of the cover layer 204 should provide an appropriate texture in order to achieve a suitable mechanical bond to the upper surface of the base 202. The cover layer 204 may be a fabric, such as a brushed knit laminated top cloth (for example, brushed knit fabric/urethane film/non-woven scrim cloth laminate) or a urethane knit laminate top cloth. Preferably, the cover layer 204 is made from a polyester fabric material.

In some embodiments, the heel portion 210 may include an insert (not shown) that is centrally located in the heel portion 210—the area of the heel portion 210 that receives the greatest force from the wearer's heel. The insert can be made of a stiffer material than the material of the base 202 to provide additional shock absorption without requiring a large increase in thickness of the heel portion 210. The insert may be secured within a shallow recess on the underside of the base 202 and may be secured by any suitable means, such as adhesive, radio frequency welding, etc. The insert may be formed of any suitable material. Suitable synthetic elastomeric polymeric materials comprise for example polymers made from conjugated dienes, for example, isoprene, butadiene, or chlorobutadiene, as well as from co-polymeric materials made from conjugated dienes and vinyl derivatives such as styrene and acrylonitrile. Exemplarily, suitable synthetic rubber materials comprise isoprene rubber, butadiene rubber, chloroprene rubber, styrene butadiene rubber (SBR), nitrile-butadiene rubber (NBR), also in hydrogenated form, ethylene-propylene-(diene) rubber (EPM, EPBM), ethylene vinyl acetate rubber, silicone rubber also including liquid silicone rubber. The insert can be made of poly(styrene-butadiene-styrene) (SBS), polyurethane foam, EVA, or a combination thereof.

As illustrated in FIGS. 3-6, the insole 200 includes a flexible arch support 100 located in a recess 232 in the bottom side 236 of the insole 200. The frame 116 may extend along the perimeter of the recess 232. The frame 116 and the recess 232 may be configured so that the lower surfaces of the frame 116 are flush with the surrounding portions of the base 202. The upper surfaces of the frame 116 may contact the bottom 234 of the recess 232 and may serve to attach the arch support 100 to the base 202. For example, the frame 116 may be adhesively fixed to the bottom 234 of the recess 232 or the base 202 may be molded to the frame 116.

In some embodiments, the flexible arch support 100 is configured and located in the insole 200 so that it is directly beneath the arch of a typical wearer's arch. For example, the flexible arch support 100 may be configured and located to extend longitudinally from at least the talus-navicular joint of a typical target wearer's foot to the medial cuneiform-first metatarsal joint and laterally under at least the medial cuneiform bone to support the arch cavity when the flexible arch support is in use.

The first set of ribs 112 may extend along the bottom 234 of the recess 232 and may be affixed to the bottom 234, such as adhesively or through the base being molded to the arch support 100. In some embodiments, the first set of ribs, or at least a portion of the first set of ribs, are not affixed to the bottom 234 of the recess 232 and may be spaced from the bottom 234 of the recess 232 when the insole 200 is not under load.

The second set of ribs 114 are spaced from the bottom 234 of the recess 232. The second set of ribs 114 may be configured to follow the general front-to-back and side-to-side contouring of the bottom of the base 202. The second set of ribs 114 may be configured so that at least a portion of the second set of ribs 114 rests against the wearer's shoe when installed in the shoe under no load. In other embodiments, at least one of the second set of ribs 114 may be configured to be spaced from the wearer's shoe when installed in the wearer's shoe under no load.

Figure 4:
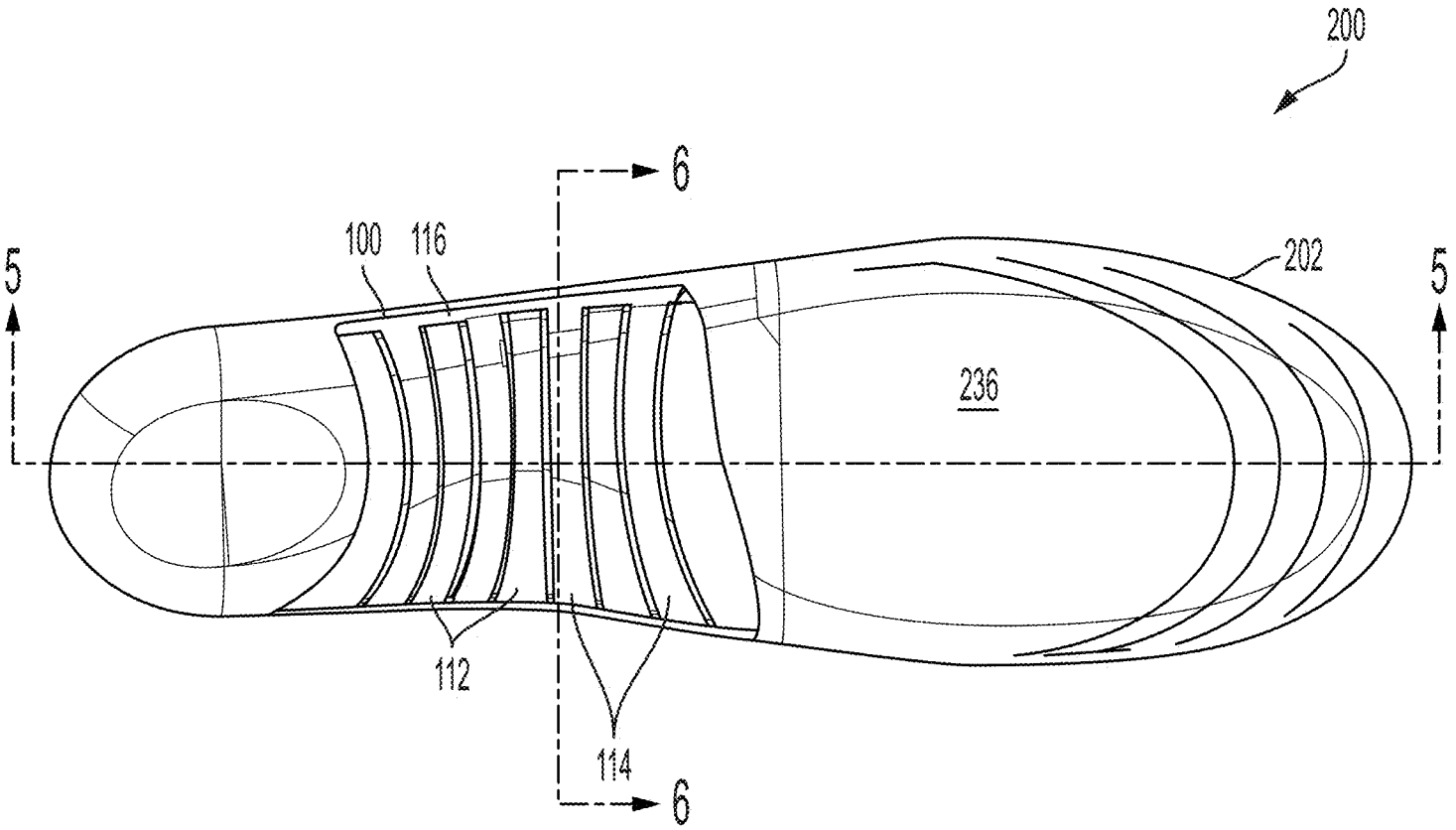
FIG. 4 illustrates a bottom view of the insole illustrated in FIG. 3.
Figure 5:
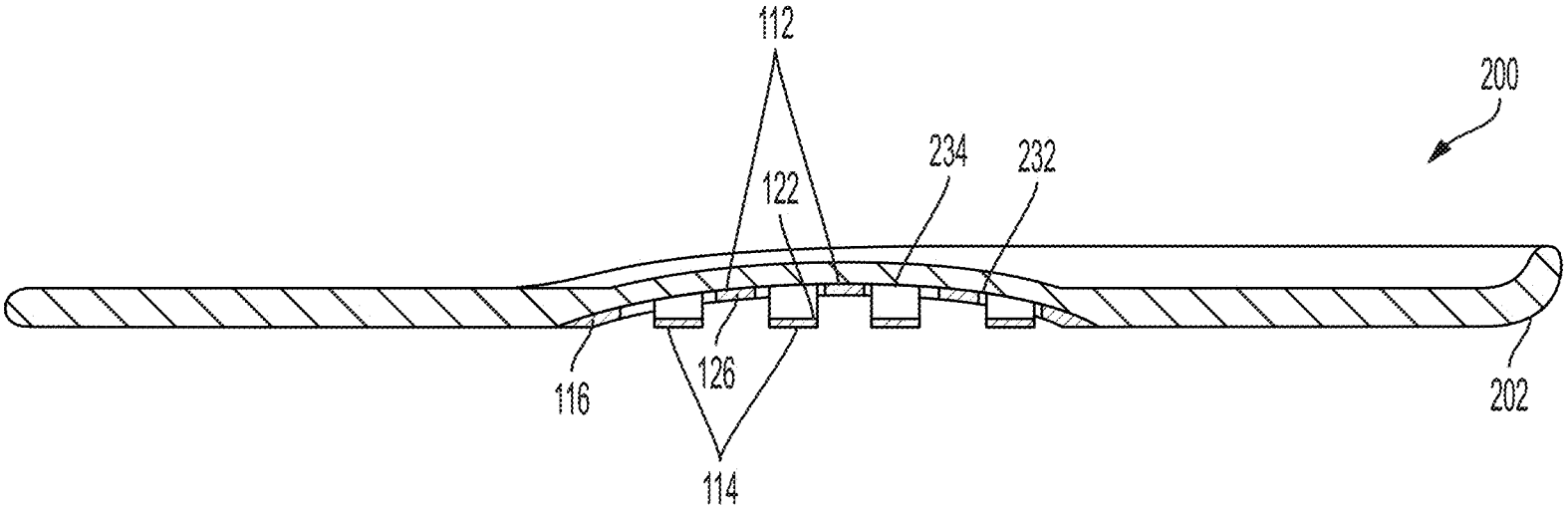
FIG. 5 illustrates a cross section of the insole illustrated in FIG. 3 through line 5-5 of FIG. 4.

FIG. 5 illustrates a cross section along a midline 5-5 of the insole 200 illustrated in FIG. 4. As illustrated, the upper surfaces 122 of the second set of ribs 114 are lower than the upper surfaces 118 of the first set of ribs 112. In the illustrated embodiment, the upper surfaces 122 of the second set of ribs 114 are spaced from the bottom 234 of the recess 232. In this embodiment, through the midline, the upper surfaces 122 are lower than the bottom surfaces 120 of the first set of ribs 112. Through the midfoot portion 220, the base 202 arches upward while the bottom surfaces 120 of the second set of ribs follows the contour of the bottom of the base 202. Therefore, ribs of the second set of ribs 114 that are in the center of the arch support 100 dip lower relative to the bottom 234 of the recess 232 than the ribs of the second set of ribs 114 that are toward the front and rear ends of the arch support 100.

Figure 6:
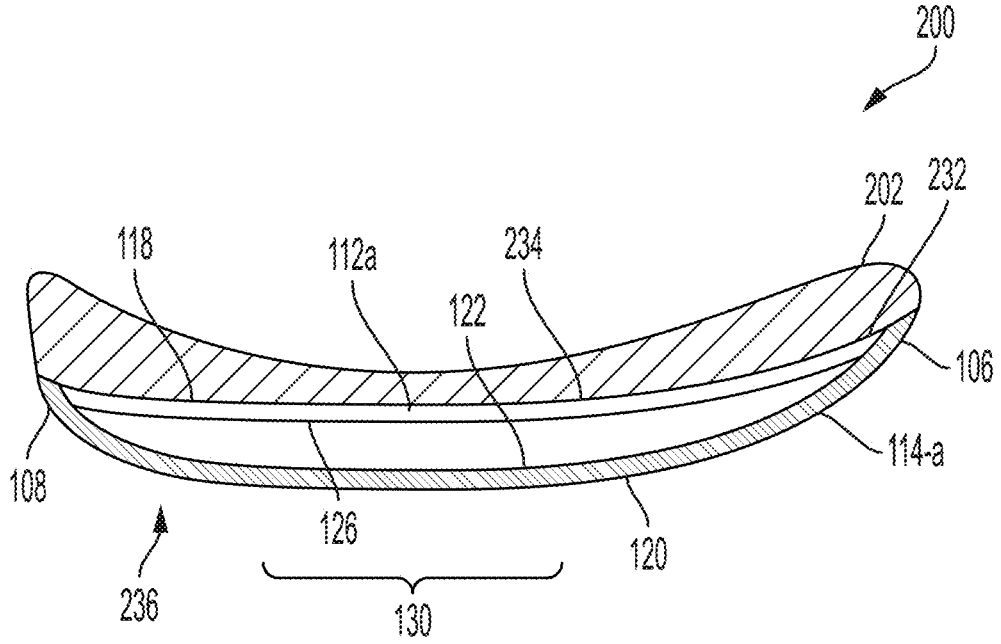
FIG. 6 illustrates a cross section of the insole illustrated in FIG. 3 through line 6-6 of FIG. 4.

FIG. 6 illustrates a lateral to medial cross section through one of the ribs of the second set of ribs, along line 6-6 of the insole 200 illustrated in FIG. 4. In the illustrated embodiment, the rib 114-*a* curves downward from the portion of the frame 116 on the lateral side 108 and from the portion of the frame on the medial side. In the center section 130, the rib 114-*a* is generally flat and uniform. One of the ribs 112-*a* of the first set of ribs 112 may be seen in the background in FIG. 6, and, as illustrated, follows along the bottom 234 of the recess 232.

Figure 7:
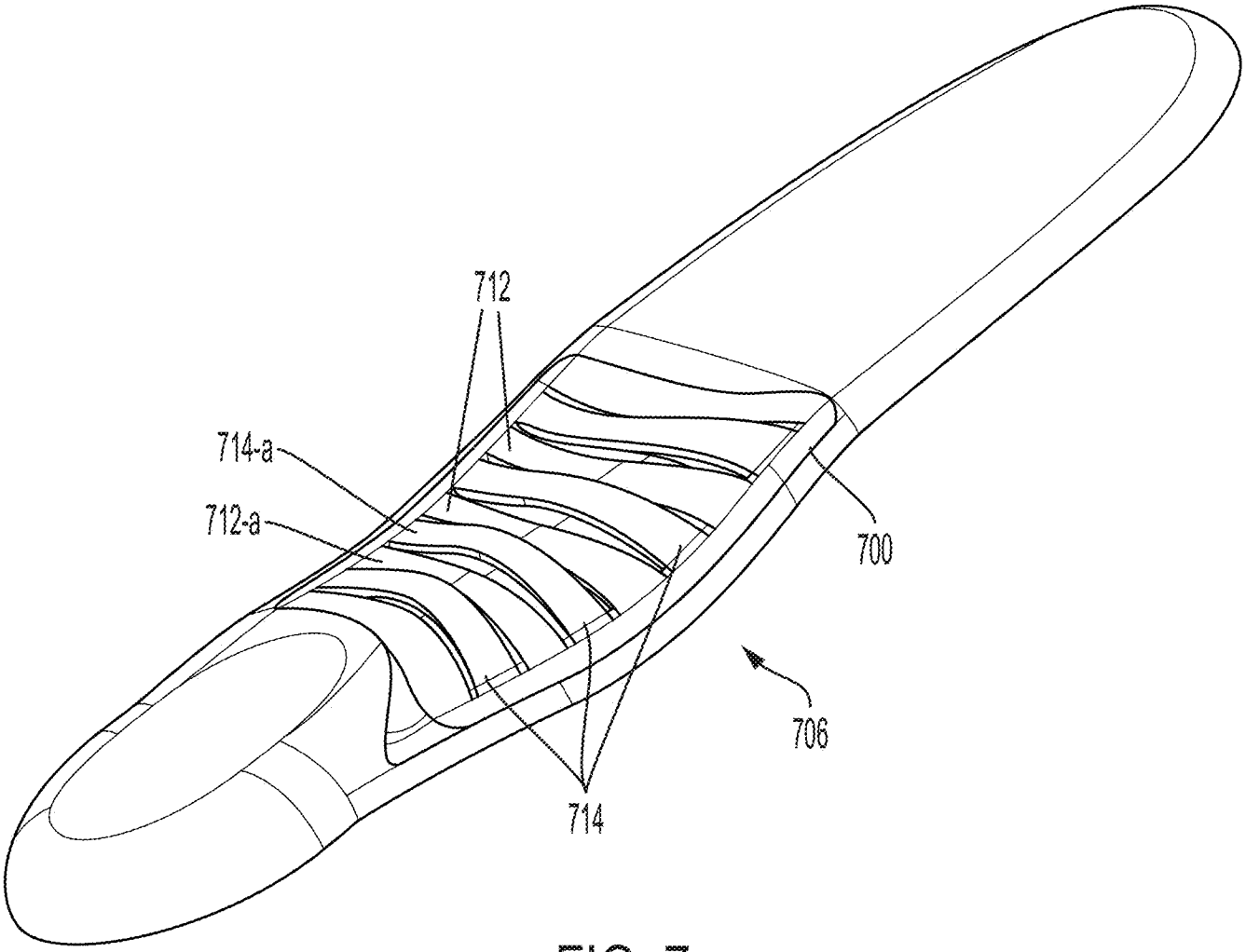
FIG. 7 illustrates a bottom perspective view of an insole, according to some embodiments.
Figure 8:
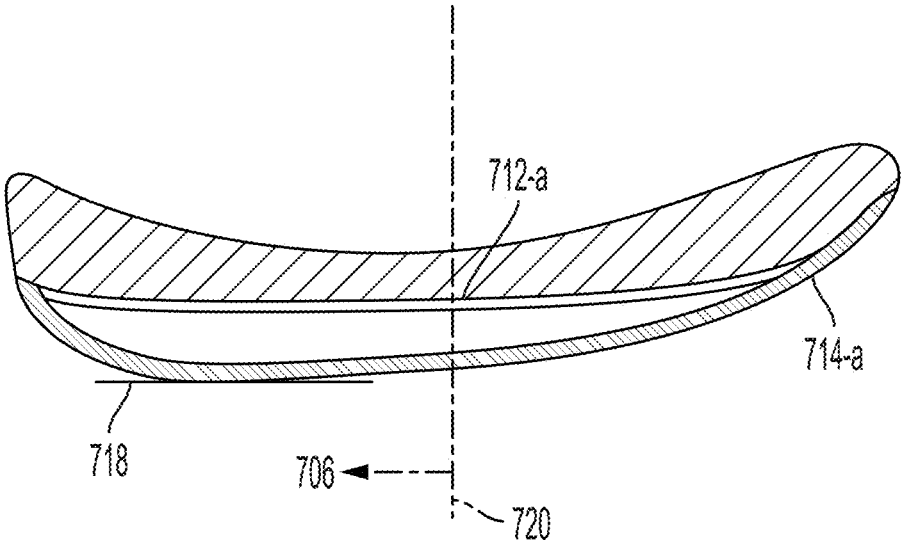
FIG. 8 illustrates a cross section of the insole illustrated in FIG. 7.

FIGS. 7 and 8 illustrate an embodiment of an insole and arch support in which the arch support 100 is thicker toward the medial side. Arch support 700 includes a second set of ribs 714 with a maximum curvature 718 that is located toward the medial side 706 of the arch support 700. FIG. 8 is a lateral to medial cross section through a rib 714-*a* of the second set of ribs 714. The lowest point of the rib 714-*a* is to the medial side of the midline 720 of the insole 200. This configuration may provide increased support for a wearer's arch relative to an embodiment in which the profile of the second set of ribs is uniform. In the illustrated embodiment, a rib 712-*a* of first set of ribs 712 has a uniform profile across the center section.

Figure 9:
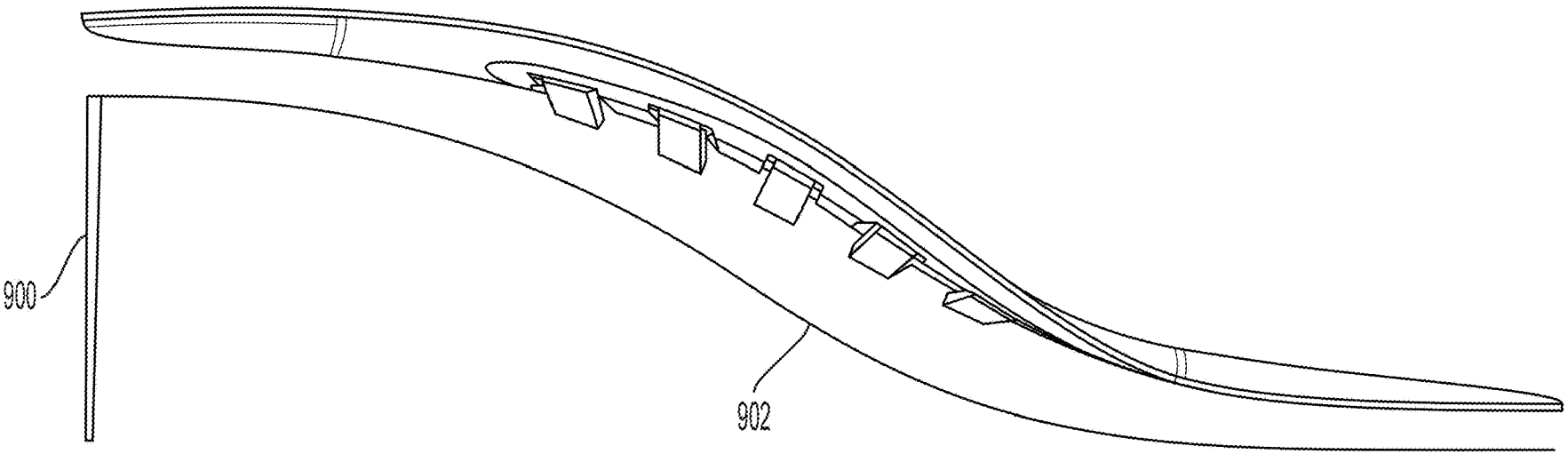
FIG. 9 illustrates a side view of an insole in a high heel shoe, according to some embodiments.

FIG. 9 illustrates how an insole incorporating the flexible arch support 100 may flex to conform to the extreme heel to toe drop of a high heel shoe 900. The gaps 124 between adjacent ribs 110 enables the arch support 100 to bend front to back to follow the large curvature of the high heel shoe 900 through the arch 902. However, due to the leaf spring ribs, the arch of the wearer is still supported without a bulky build-up of material.

Figure 12:
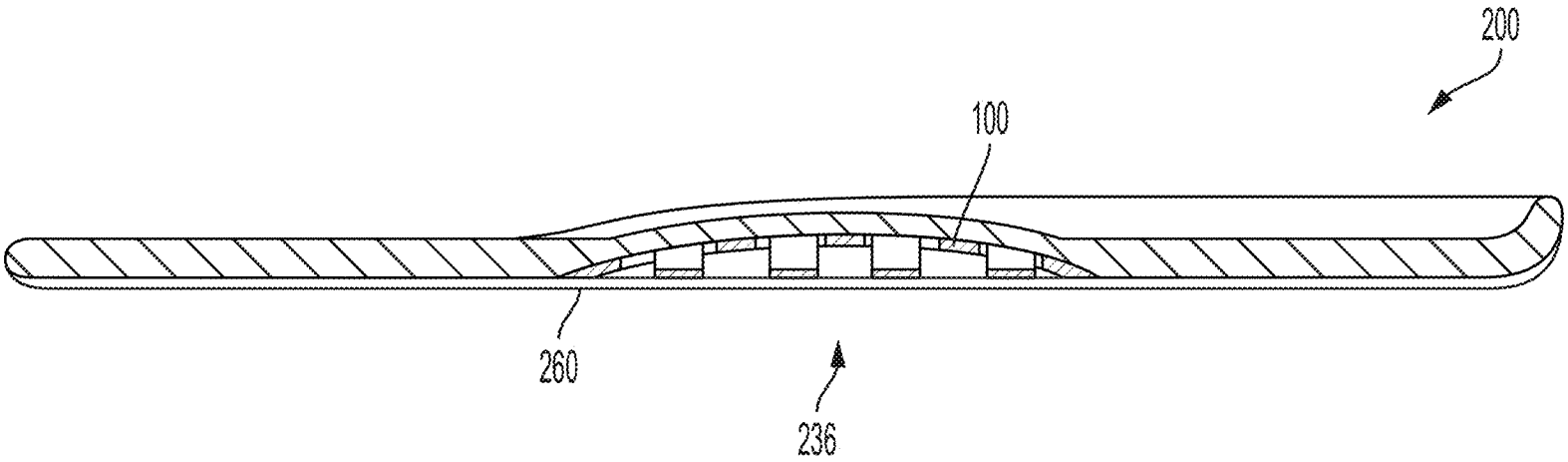
FIG. 12 illustrates an embodiment in which a layer of material is provided on a bottom side of an insole.

In some embodiments, the flexible arch support is an "inner layer" of an insole in which one or more layers encase the flexible arch support. FIG. 12 illustrates an embodiment in which a layer 260 of material is provided on the bottom side 236 of the insole 200. This layer 260 of material may be, for example, a tacky material that could grip the insole 200 to the shoe. In some embodiments, the layer 260 may be provided across the entire bottom 236 of the insole 200, as illustrated in FIG. 12, or may only extend beneath a portion of the insole 200, such as beneath just the arch support 100. In some embodiments, the bottom side 104 of the insole 100 is covered, such as by layer 260, while the plantar side 102 is not covered by any material. For example, the base 202 may include a cut-out in the midfoot portion 220 so that the plantar side 102 of the arch support is exposed and the upper surfaces 118 of the first set of ribs 112 may directly contact a wearer's foot.

Figure 13:
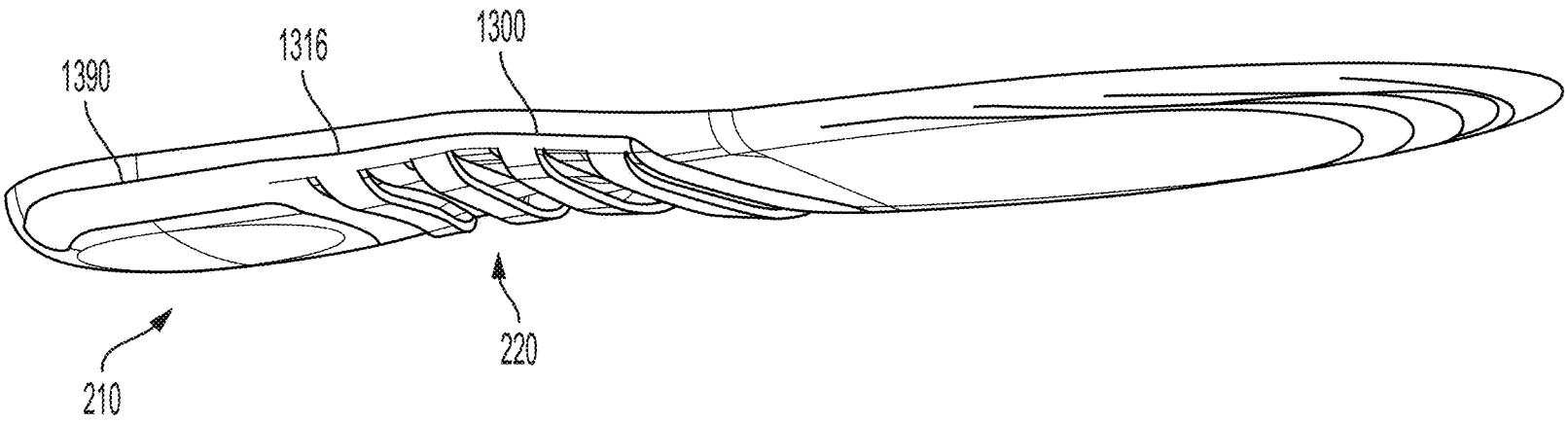
FIG. 13 illustrates an embodiment in which a frame of a flexible arch support extends into the heel portion of the insole.

In some embodiments, the frame of the flexible arch support may extend beyond the midfoot portion 220 to the heal portion 210, for example, to provide additional heel support. FIG. 13 illustrates an embodiment in which a frame 1316 of a flexible arch support 1300 extends into the heel portion 210 of the insole 200. In this embodiment, an open ring-like extension 1390 of the frame 1316 wraps around a heel portion of the base 202 on both the medial and lateral sides (only the medial side is shown). In some embodiments, the extension 1390 may form a closed ring-like extension.

According to various embodiments, the flexible arch support may be made from thermoplastic material, e.g., thermoplastic polyurethane; foamed materials, e.g. EVA, polyurethane foam; or thermoset materials, e.g., composites. The flexible arch support may be constructed from a thermoplastic olefin polymer that may be stiff and flexible, e.g., polyethylene, polypropylene, polyurethane, or elastomers, or a combination of thermoplastic polyurethane and acrylonitrile-butadiene-styrene. One example may be UH-64D20 thermoplastic polyurethane (TPU) from Uretech Company, Cheng-Hwa Hsien, Taiwan, Republic of China. Other examples include: a fiberglass filled polypropylene; nylon; fiberglass; polypropylene; woven extrusion composite; ABS; thermoplastic polymer; carbon graphite; polyacetal, for example, as sold under the trademark "DELRIN" by E.I. du Pont de Nemours and Company of Wilmington, Del. U.S.A.; or any other suitable material. The flexible arch support may be made of TPU, for example, TPU having a Shore hardness of about 95±5 Shore A to about 64±5 Shore D. In some embodiments, the flexible arch support is made of a polyamide, such as the polyamide sold under the trademark "Novamid." The flexible arch support may be 3D printed or injection molded. The flexible arch support may be a unitary piece or may be an assembly of different pieces.

Material thickness of the flexible arch support may be tailored according to the design requirement of a particular application. In some embodiments thickness of the ribs and frame may be generally constant throughout the arch support. In some embodiments, the frame may become thinner toward the outer periphery of the arch support, such as to conform to the contours of an insole into which it is incorporated. In some embodiments, the thickness of each rib is uniform throughout the rib while in other embodiments, the thickness of a rib is non-uniform. For example, the thickness may increase from one end of a rib to a maximum at the center of the rib and then decrease at the opposite end. In some embodiments, at least some of the ribs have the same thickness. For example, all of the first set of ribs may have the same thickness and/or all of the second set of ribs may have the same thickness. In some embodiments, thickness of ribs in the same set of ribs varies. For example, ribs closer to the sides of the flexible arch support may be thinner than ribs at the center at the same relative location on the ribs.

FEA Comparison Between Conventional Arch Shell and Arch Support Embodiment

Figure 10B:
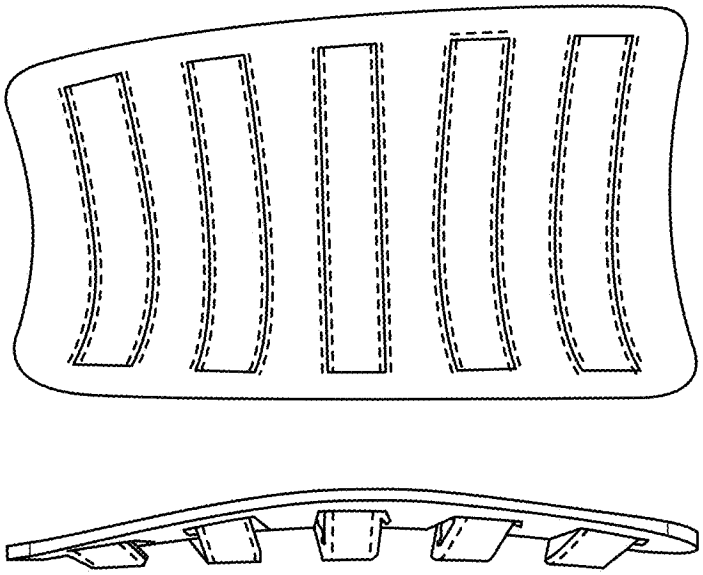
FIG. 10A illustrates a conventional arch shell configuration used for an FEA analysis and FIG. 10B illustrates the configuration of a flexible arch support embodiment used for the FEA analysis.
Figure 10A:
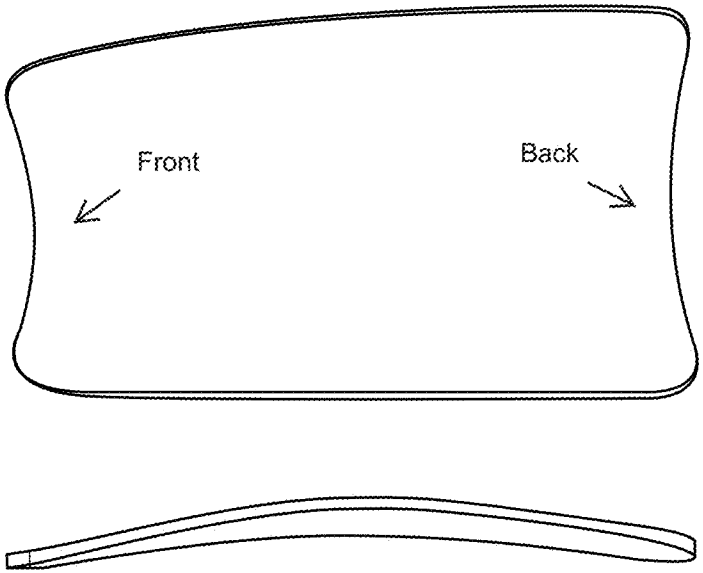

Finite element analysis (FEA) simulations were performed on an example embodiment of the flexible arch support to quantitatively evaluate the flexibility of the flexible arch support embodiment as compared to a conventional flexible arch support design. FIG. 10A illustrates the configuration of a conventional arch shell used for the simulations. The conventional arch shell has a contoured but generally uniformly rigid shape that acts as a supportive spring under the arch during the stance phase of gait. FIG. 10B illustrates the configuration of the flexible arch support embodiment used for the simulations. The overall dimensions and curvature of the conventional arch shell and flexible arch support embodiment are the same.

In the simulations, a rigid fixture was applied to the back face of each arch support. A uniform 10 Newton force was applied to the front face of each arch support normal to the axial plane of each model. Typical acrylonitrile butadiene styrene (ABS) material properties were applied to each model prior to running the simulation (Young's Modulus=2e+9 $N/m^2$). The mesh density was balanced with a global mesh size of 4.63 mm±0.23 mm. The internal stress (von Mises) within each arch support were quantified in $N/m^2$ and the displacement (i.e., flexion) of each arch support were quantified in millimeters.

Figure 11A:
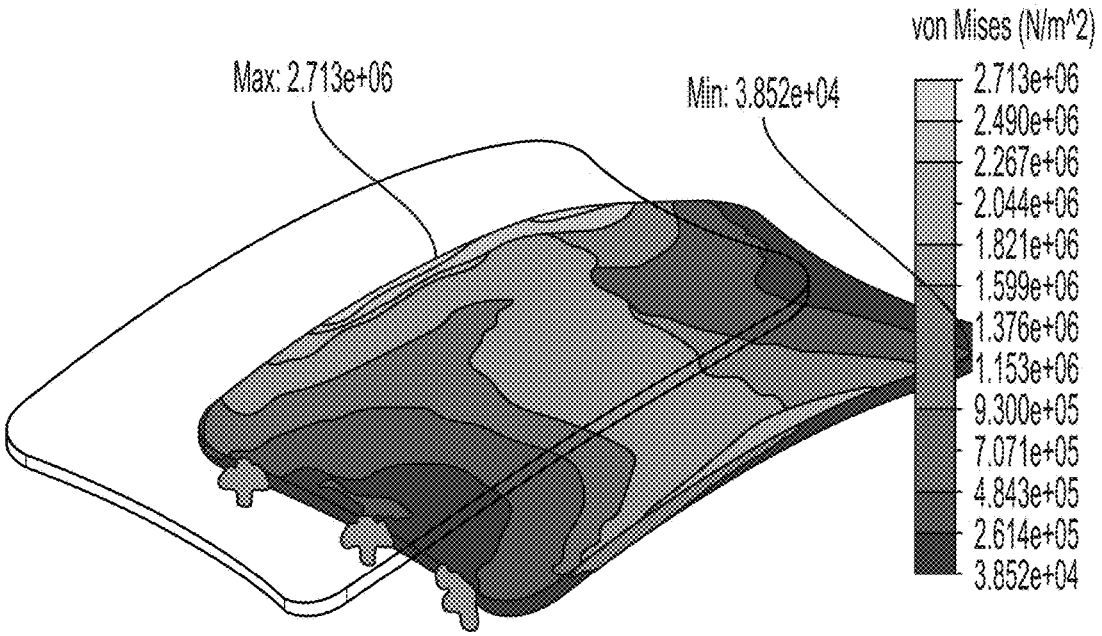
FIGS. 11A-B illustrate the von Mises stress results of the FEA analysis of the conventional arch shell of FIG. 10A and the flexible arch support embodiment of FIG. 10B, respectively.
Figure 11B:
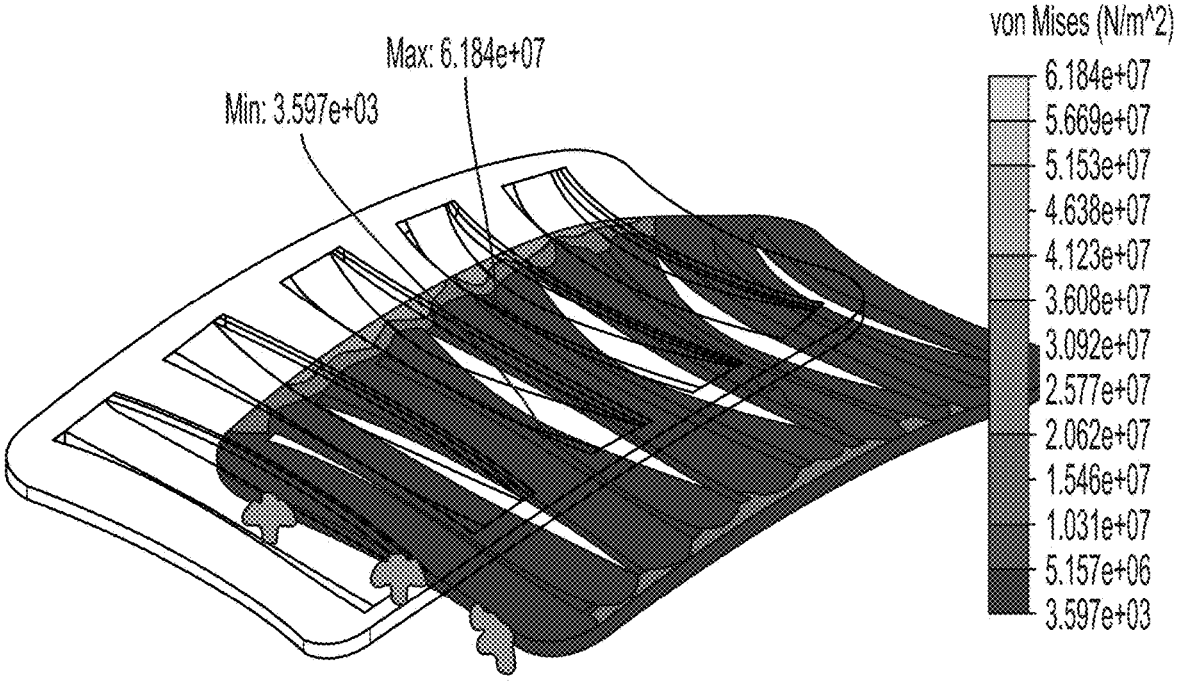
Figure 11C:
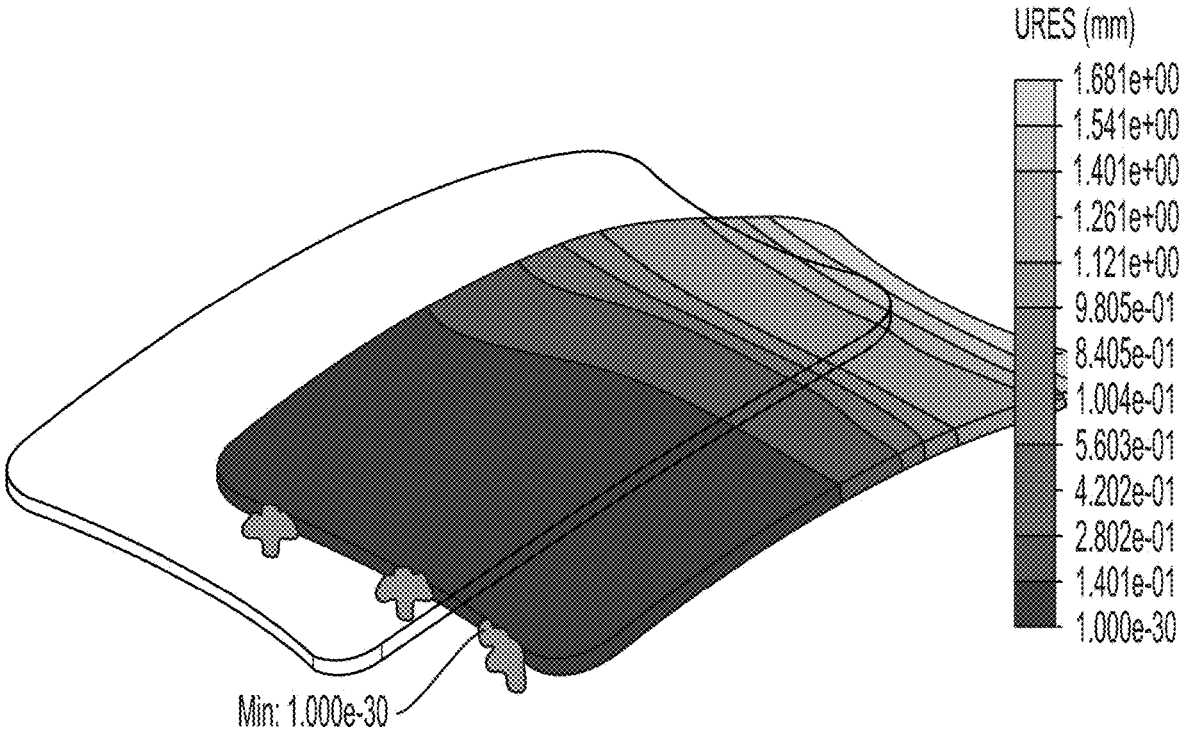
FIGS. 11C-D illustrate the displacement results of the FEA analysis of the conventional arch shell of FIG. 10A and the flexible arch support embodiment of FIG. 10B, respectively.
Figure 11D:
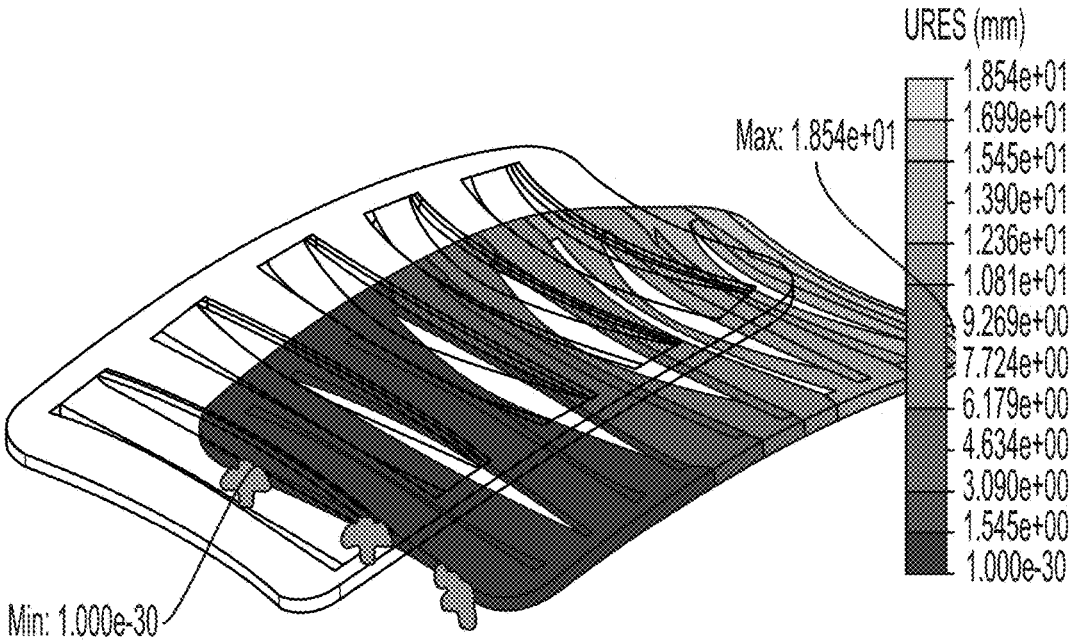

FIGS. 11A and 11B show the FEA results for the von Mises stresses for the conventional arch shell and the flexible arch support embodiment, respectively, and FIGS. 11C and 11D show the displacement for the conventional arch shell and the flexible arch support embodiment, respectively. The scales are not the same for the conventional arch shell and the flexible arch support embodiment, but the values are shown on their respective scales. Comparing FIG. 11A to FIG. 11B, the minimum von Mises stress was 10.71 times higher for the conventional arch shell as compared to the flexible arch support embodiment.

While the overall maximum von Mises stress was higher in the flexible arch support embodiment, the overall average von Mises stress was higher in the conventional arch shell as compared to the flexible arch support embodiment. This would cause the conventional arch support to resist bending under applied loads more so than the flexible arch support embodiment. In fact, for the simulations, the displacement was 11.03 times greater for the flexible arch support embodiment versus the conventional arch shell. These results demonstrate that, under simulated loading conditions, a flexible arch support embodiment is more flexible than a conventional arch support, which is due at least in large part to the material gaps separating the alternating support ribs. In practice, this flexibility would allow the flexible arch support to conform and move with high fashion footwear to a greater degree as compared to conventional arch shells while providing arch support via the independent and alternating leaf springs ribs.

Consumer Testing

Ultimately, the perceived comfort of an insole is an important outcome needed to evaluate its ability to improve the fit of high fashion footwear such as high heels or ballet flats. Therefore, initial and extended fit and feel was evaluated in 28 healthy female volunteers while wearing high heeled shoes with and without insoles fabricated with an embodiment of an insole having a flexible arch support, according to the principles described above. The subjects compared two insoles embodiments having a flexible arch support to a conventional high heel insole (Dr. Scholl's Stylish Step High Heel Relief Insoles, Bayer Consumer Health, Whippany NJ) during the initial fit and feel wear test.

The dimensions and flexible arch support were equivalent for the two flexible arch support insole embodiments. However, the base materials were different—one was Styrene Ethylene Butylene Styrene (SEBS) gel and the other was Polyurethane foam. Each subject was asked to place a pair of insoles (one of the two flexible arch support insole embodiments or the conventional arch shell insole) in their own high heeled shoes and then take a short walk (approximately 3-4 minutes) followed by a set of initial wear fit and feel questions. This process was repeated for the other two of the three test insoles. The order in which the insoles were worn was randomized between subjects. The consumers were asked to rank the insoles (#1=best, #3=worst) on overall comfort after finishing all of the short walks with each of the tested insoles. Each subject was then asked to take home and wear either the gel or foam flexible arch support insole embodiments in their own high heeled shoes. The subjects were sent a set of extended wear fit and feel questions to answer after wearing the insoles for one week.

Greater than 80% of the subjects felt that the flexible arch support insole embodiments were ranked in the top 2 (out of three) based on overall comfort as compared to less than 40% for the conventional insoles (P<0.001). Approximately 97% of the subjects felt that the flexible arch support insole embodiments were not difficult to install (92.9% and 100% for the gel and foam, respectively) into their high heels as compared to 85.7% for the conventional insole. Approximately 91% of the subjects felt that the flexible arch support insole embodiments were moderately comfortable or better (92.8% and 89.2% for the gel and foam versions, respectively) when they first put their high heels on and stood up as compared to 46.5% for the conventional insoles (P<0.001). Approximately 75% of the subjects felt that the flexible arch support insole embodiments made their shoes more comfortable (78.6% and 71.4% for the gel and foam versions, respectively) after wearing them while walking for three to four minutes as compared to 35.7% for the conventional insoles (P<0.001). Approximately 71% of the subjects were satisfied with the flexible arch support insole embodiments (67.8% and 75% for the gel and foam versions, respectively) after wearing them while walking for three to four minutes as compared to 28.6% for the conventional insoles (P<0.004). Finally, approximately 80% of the subjects felt that the flexible arch support insole embodiments fit their arch "Just right" (92.9% and 67.9% for the gel and foam versions, respectively) after wearing them while walking for three to four minutes as compared to 60.7% for the conventional insoles (P<0.05).

Approximately 79% of the subjects felt that the flexible arch support insole embodiments made their high heels more comfortable (78.6% for both gel and foam versions) after wearing them in their high heels for one week. Approximately 79% of the subjects were satisfied with the flexible arch support insole embodiments (78.6% for both gel and foam versions) after wearing them in their high heels for one week. Approximately 89% of the subjects felt that the flexible arch support insole embodiments fit their arch "just right" (85.7% and 92.9% for the gel and foam versions, respectively) after wearing them in their high heels for one week. Finally, 71.4% of the women indicated that, if given the opportunity, they would continue wearing the flexible arch support insole embodiments after the study ended.

These results show the efficacy of employing the flexible arch support into an insole embodiment intended to be used in high heels. Overall, the far majority of subjects (≥75%) felt that the flexible arch support insole embodiments made their shoes more comfortable during both initial and extended wear tests. Significantly, the flexible arch support insole embodiments fit the almost 90% of the subjects arches "just right" after an extended period of wear.

Clinical Study

Two multi-center evaluations were conducted to independently evaluate the benefit of high heel insoles and ballet flat insoles each fitted with an embodiment of the flexible arch support.

The multi-center evaluation of the high heel insole was performed to evaluate how high heel insoles fitted with an embodiment of the flexible arch support aided in the relief of pain experienced from wearing high heel shoes. A total of one hundred and eleven (111) healthy female subjects were screened for study eligibility. Ninety (90) subjects qualified for study enrollment and eighty-nine (89) subjects completed the study. The inclusion criteria were women, 18-60 years of age, who have experienced mild to moderate foot pain from wearing high heel shoes at least four days out of a typical week. One pair of high heel insoles with an embodiment of the flexible arch support were evaluated. Subjects were asked to wear the insoles in their shoes for a minimum of eight (8) hours per day, for a minimum of four days over a one-week period. Pain level, shoe/insole fit, and foot comfort questionnaires were completed.

The reduction in level of foot pain experienced when wearing the insoles fitted with an embodiment of the flexible arch support in high heels is shown in Table 1.

TABLE 1

| Evaluation | N | Treatment Mean | Mean Difference From Baseline | Percent Change Mean [1] | Within-Treatment t-test p-value | Percent Subjects Improved from Baseline (%) |
|---|---|---|---|---|---|---|
| Baseline | 89 | 56.67 | | | | |
| Immediate | 89 | 33.27 | −23.40 | −41.3% | <0.0001* | 89.9% |
| Day 1 | 89 | 29.92 | −26.76 | −47.2% | <0.0001* | 89.9% |
| Day 7 | 89 | 19.65 | −37.03 | −65.3% | <0.0001* | 97.8% |

Referring to Table 1, the evaluation column refers to when the questionnaires were completed—baseline (prior to entering the study and donning the insole), immediate (in short period immediately after donning the insole), day 1 (after one day of wear), and day 7 (after seven days of wear). The N column refers to the number of subjects who completed all four of the questionnaires. The treatment mean refers to the level of foot pain experienced by ladies at each evaluation period ranked on a zero to one-hundred scale where a higher value represents more pain. The mean difference in pain from baseline for each evaluation period is presented as a number value and corresponding percentage change.

Each of the evaluation periods showed significant reductions in pain as denoted by the Within-Treatment t-test p-value column. The percent of subjects who had less pain as compared to baseline was approximately 90%, 90%, and 98%, respectively, for the Immediate, Day 1, and Day 7 evaluations. Additionally, the high heel insoles fitted with an embodiment of the flexible arch support improved the immediate fit of high heel shoes in approximately 63% of the subjects ($p=0.0192$). Approximately 61% and 66% of the subjects had improved fit after one day ($p=0.0558$) and seven days ($p=0.0028$) of wear, respectively. Finally, approximately 11% of the subjects reported feeling comfort at baseline without the high heel insoles fitted with the flexible arch support. Approximately 66% of the subjects reported feeling comfort immediately after donning the insoles ($p<0.0001$). Furthermore, approximately 71% ($p<0.0001$) and 87% ($p<0.001$) of the subjects reported feeling comfort after one day of wear and after seven days of wear, respectively.

The multi-center evaluation of the ballet flat insole was performed to evaluate how ballet flat insoles fitted with an embodiment of the flexible arch support aided in the relief of pain experienced from wearing ballet flat style shoes. A total of forty-six (46) subjects were screened for study eligibility. Thirty-three (33) subjects qualified for study enrollment and completed the study. The inclusion criteria were women, 18-60 years of age, who wear ballet flat closed heel shoes (shoes with ≤1.25 inches high) at least four days out of a typical week and who experienced discomfort and foot and leg fatigue when wearing their ballet flat shoes. Subjects were asked to wear the ballet flat insoles fitted with an embodiment of the flexible arch support in their shoes for one week with one extended wear day of approximately 12 hours. Subjects assessed the insole for comfort, relief of foot and leg fatigue, foot support and fit.

Improvement in overall foot comfort experienced when wearing insoles fitted with an embodiment of the flexible arch support in ballet flat style shoes is shown in Table 2.

TABLE 2

| Evaluation | N | Treatment Mean | Mean Difference From Baseline | Within-Treatment Signed Rank p-value |
|---|---|---|---|---|
| Baseline (Prior to Insole Use) | 33 | 2.18 | | |
| Immediate (1 Minute after Insole Placement) | 33 | 5.39 | 3.21 | <0.0001* |
| Day 1 (8 Hours after use) | 33 | 5.45 | 3.27 | <0.0001* |
| Day 7 (8 Hours after use) | 33 | 5.91 | 3.73 | <0.0001* |
| Day 7 (12 Hours after use) | 33 | 5.70 | 3.52 | <0.0001* |

Referring to Table 2, overall foot comfort is shown on a zero to seven-point scale (a higher value representing more comfort) for each evaluation period—baseline (prior to donning the insole), immediate (1-minute after donning the insole), on day 7 after 8 hours of use, and on day 7 after 12 hours of use. The overall foot comfort improved significantly from baseline at each of the evaluation periods ($p<0.001$). Additionally, greater than 90% of the subjects reported that their foot and arch was supported by the insole in their ballet flat style shoes after each evaluation period (immediate, day 1, and day 7).

Although the present invention uses the term "insole," it will be appreciated that the use of other equivalent or similar terms such as "innersole" or "insert" are considered to be synonymous and interchangeable, and thereby, they are included in the presently claimed invention.

Further, although the present invention has been described primarily in connection with removable insoles, the invention can be incorporated directly into the sole of a shoe, and the present invention is intended to cover the same. In this regard, reference is made in the claims to an insole for use with footwear, including a removable insole or an insole built into a shoe. If built into a shoe, for example, the heel portion could be fixed and the mid portion and forefoot portions could be allowed to elongate as the foot flexes.

The foregoing description, for the purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying figures, it is to be noted that various changes and modifications will become apparent to those skilled in the art. Such changes and modifications are to be understood as being included within the scope of the disclosure and examples as defined by the claims. Finally, the entire disclosure of the patents and publications referred to in this application are hereby incorporated herein by reference.

We claim:

1. An insole for insertion into footwear, comprising:

a base; and an arch support located on an underside of the base, the arch support comprising:

a frame forming at least a portion of a perimeter of the arch support, a first side of the frame configured to underlie a medial side of a wearer's foot and a second side of the frame configured to underlie a lateral side of the wearer's foot, and a plurality of ribs extending from the first side of the frame to the second side of the frame, wherein a first set of the ribs is raised relative to a second set of the ribs, and wherein the first set of ribs are positioned entirely between the second set of ribs to form an alternating array of opposing independent leaf spring ribs configured to move toward each other in response to application of force by a wearer's foot.

2. The insole of claim 1, wherein the first set of the ribs contacts the underside of the base.

3. The insole of claim 1, wherein at least a portion of an upper side of the second set of the ribs is lower than at least a portion of the lower side of the first set of ribs.

4. The insole of claim 1, wherein a lowest portion of at least one rib of the second set of ribs is located toward a medial side of the insole.

5. The insole of claim 1, wherein a central longitudinal portion of at least one rib of the second set of ribs is uniform in height.

6. The insole of claim 1, wherein the arch support is formed of a different material than the base.

7. The insole of claim 1, wherein the arch support is formed of a stiffer material than the base.

8. The insole of claim 1, wherein the plurality of ribs are spaced apart.

9. The insole of claim 1, wherein the frame and the plurality of ribs are formed of the same material.

10. The insole of claim 1, wherein the base comprises a recess and the arch support is located in the recess.

11. The insole of claim 1, wherein the frame is flush with a bottom of the base around a perimeter of the frame.

12. The insole of claim 1, wherein at least one end of at least one rib of the second set of ribs curves downward.

13. The insole of claim 1, wherein a bottom surface of at least one rib of the second set of ribs contacts a planar surface when a bottom side of the insole is placed on the planar surface.

14. The insole of claim 1, wherein at least one rib of the second set of ribs has a uniform thickness from a first end of the at least one rib of the second set of ribs to a second end of the at least one rib of the second set of ribs.

15. The insole of claim 1, wherein at least one rib of the first set of ribs has a uniform thickness from a first end of the at least one rib of the first set of ribs to a second end of the at least one rib of the first set of ribs.

16. The insole of claim 1, wherein the base is formed of a foam or a gel.

17. The insole of claim 1, wherein the insole comprises a heel portion.

18. The insole of claim 1, wherein the insole comprises a forefoot portion.

* * * * *